US005921323A

United States Patent [19]

Cronk

[11] Patent Number: 5,921,323

[45] Date of Patent: Jul. 13, 1999

[54] CHIMNEY FIRE ACCESS DEVICE

[76] Inventor: Kyle Cronk, 16 Erie St., Fisherville, Canada, N0A 1G0

[21] Appl. No.: 08/881,366

[22] Filed: Jun. 24, 1997

[51] Int. Cl.[6] ..... A62C 37/12

[52] U.S. Cl. ..... 169/70; 169/54; 169/65

[58] Field of Search ..... 169/54, 65, 70; 137/171, 185, 215, 247.41; 126/532, 536, 554; 431/145; 110/122, 256; 131/201, 256

[56] References Cited

U.S. PATENT DOCUMENTS

| | | | |
|---|---|---|---|
| 369,636 | 9/1887 | Eppelsheimer . | |
| 389,025 | 9/1888 | Stevens . | |
| 1,898,117 | 2/1933 | Boosey . | |
| 2,297,808 | 10/1942 | Soucy | 169/54 X |
| 2,535,311 | 12/1950 | McGann, Jr. . | |
| 3,510,252 | 5/1970 | Reich | 137/171 X |
| 4,047,572 | 9/1977 | Stacy . | |
| 4,194,570 | 3/1980 | Arencibia, Jr. . | |
| 4,434,784 | 3/1984 | Van Patten . | |
| 4,481,933 | 11/1984 | Sawtelle . | |
| 4,516,278 | 5/1985 | Lamond | 137/247.41 X |
| 4,519,458 | 5/1985 | Kroeter | 169/65 X |
| 4,872,513 | 10/1989 | Gardner . | |
| 4,987,958 | 1/1991 | Fierbaugh | 169/65 X |
| 5,036,924 | 8/1991 | Carino . | |
| 5,511,622 | 4/1996 | Thompson . | |
| 5,706,854 | 1/1998 | Haynes | 137/526 |

*Primary Examiner*—Andres Kashnikow
*Assistant Examiner*—Robin O. Evans
*Attorney, Agent, or Firm*—Paul J. Field

[57] ABSTRACT

The invention provides a chimney fire access device for injecting a fire extinguishing compound into the interior of an elongate vertical chimney stack, the stack having: a side wall and a longitudinal axis, the device comprising: a tube extending transversely through the stack side wall, the tube having an input end, a midportion and an output end; mounting means for mounting the tube to the stack side wall; nozzle means disposed on the output end of the tube for spraying a fire extinguishing compound in an upstream direction; trap means disposed within the midportion of the tube for impeding backflow of solid particles from the interior of the stack through the side wall; and fire extinguishing compound injection means disposed on the input end of the tube for conveying compound from a source of extinguishing compound.

7 Claims, 5 Drawing Sheets

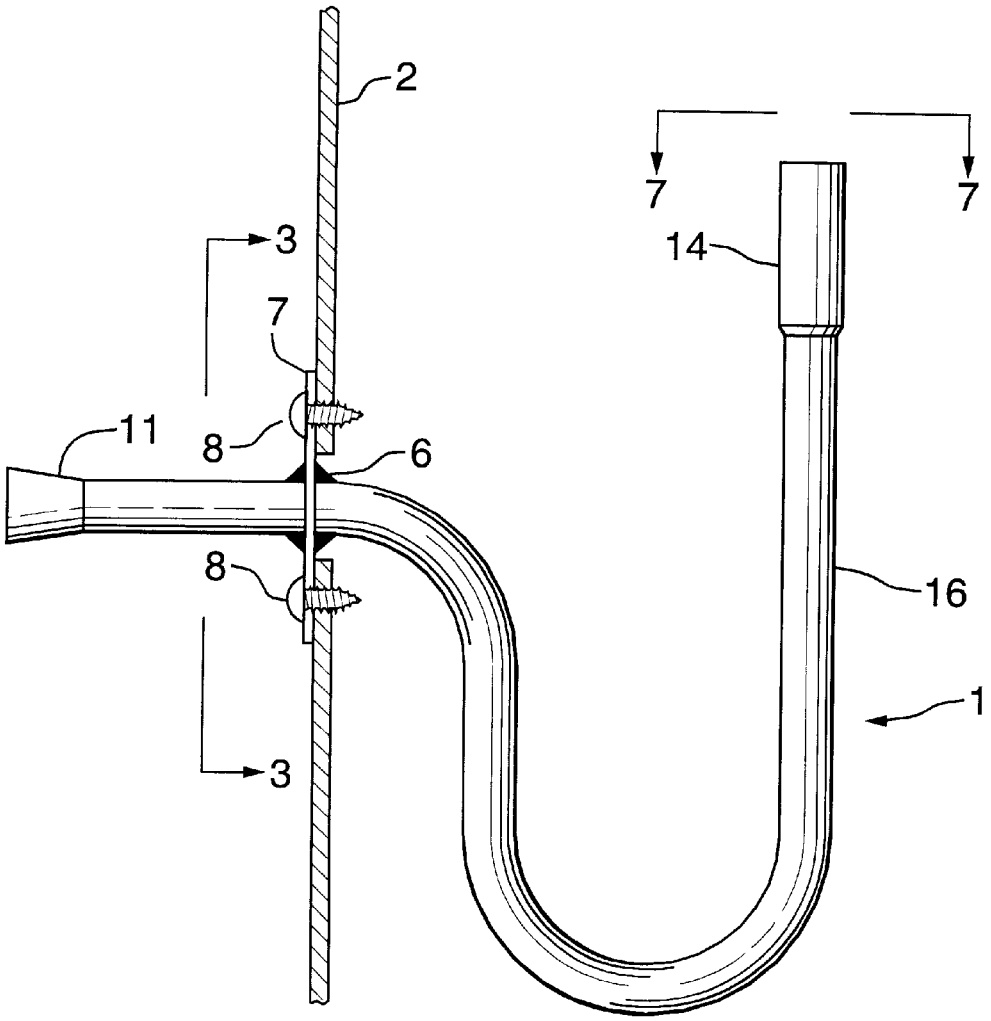
FIG.2
FIG.3
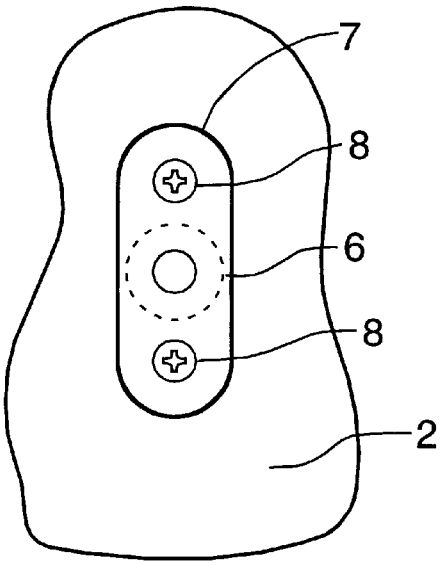

CHIMNEY FIRE ACCESS DEVICE

TECHNICAL FIELD

The invention is directed to a chimney fire access device for facilitating the injection of fire extinguishing compound into the interior of an elongate vertical chimney stack, and in particular, an access device with means to impede backflow of solid particles from the interior of the stack.

BACKGROUND OF THE ART

The burning of wood and other fuels in wood stoves, ovens or fireplaces results in the gradual buildup of soot, creosote, resin and other combustible materials on the interior surfaces of chimney stacks. Burning of so-called "green wood", which is freshly cut wood that has not been allowed to cure or age adequately, especially contributes to residue buildup.

Fires in chimney stacks are common occurrences especially in rural and recreational areas where use of wood burning stoves is prevalent. Proper cleaning of the chimney stack on a regular basis reduces the risk of chimney fires. The choice of fuel to burn also reduces fire risk, since burning of soft wood, paper, plastics and garbage greatly increase the buildup of combustible material.

However, in many cases the risk of chimney fires is a significant matter especially in rural areas where fire fighting response is relatively slow and lacking in equipment. In many cases, wood burning stoves use sheet metal cylindrical chimney stacks. The sheet metal stack offers very little resistance to fire spread and the chimney fire rapidly spreads to the interior of the building.

Conventional fire fighting methods include climbing on the building roof and spraying water down the chimney stack. This method is of course only practical if the fire has not spread significantly to the roof of the building by the time fire fighters arrive. It also results in significant water damage to the building interior.

Use of a hand held portable fire extinguisher is possible however such a method is risky and often ineffective. A chimney fire generally occurs within the enclosed stack above the damper which obstructs access and flow of extinguisher compound. In addition, to access the burning interior of the stack, first the fire in the wood stove itself must be extinguished. The user must then insert the portable extinguisher inside the hot smoke filled stove and properly aim the fire extinguisher nozzle up the stack without burning himself. Due to the obstruction of the damper and frequent bends in the stove flue or chimney stack, the rapid delivery of fire extinguishing compound to the area of the stack under fire is doubtful, risky and inefficient.

Conventional responses to this problem have been partially successful, however, complex or costly fire extinguishing systems are very unlikely to be widely adopted for very simple reasons. Wood burning stoves are used because the fuel is relatively inexpensive. Purchase of an elaborate expensive fire extinguishing system is unlikely. Wood burning stoves are also usually installed by homeowners or other relatively unskilled persons for their own use. Complicated fire extinguishing systems are unlikely to be properly installed or even purchased by such users.

Examples of relatively complicated fire extinguishing systems are described in the following United States Patents: U.S. Pat. No. 4,194,570 to Arenciia, Jr.; U.S. Pat. No. 4,872,513 to Gardner et al; and U.S. Pat. No. 4,434,784 to Van Patten.

In U.S. Pat. No. 4,481,933 to Sawtelle, a simple access tube is mounted to a horizontal sheet metal chimney stack. The tube has a bent right angle to aim fire extinguishing compound downstream from the damper. A portable fire extinguisher is positioned at the outer end of the tube to spray fire extinguishing compound inside the chimney stack.

The primary disadvantage of Sawtelle's system is apparent when the device is installed in a vertical chimney stack. Most chimney stacks are in fact primarily vertical. The use of a vertical stack efficiently exhausts hot fumes and minimizes resin buildup inside the stack.

Use of Sawtelle's system on a vertical stack would result in backflow of cinders, ashes and other solid particles. The solid particles can fall down a chimney stack into the inner open end of the tube and out into the occupied building. Backflow of solid particles through the tube can cause fires within the building as cinders fall on combustible materials such as carpets, papers and wood floors. Since the open inner end of the tube must face upward to direct spray up a vertical stack, use of Sawtelle's device in a vertical stack would subject a building and occupants to an unacceptable risk of fire. At the very least, the backflow of solid particles results in a sprinkling of adjacent areas with black soot, and at worst presents a serious risk of injury to people and property.

It is desirable therefore to produce a safe, simple and inexpensive device to provide access to the interior of a chimney stack in the event of chimney fire, while minimizing the risk of backflow. Preferably the device is simple enough to enable use of commonly available tools and require a low level of skill.

DISCLOSURE OF THE INVENTION

The invention provides a novel chimney fire access device for injecting a fire extinguishing compound into the interior of an elongate vertical chimney stack, the stack having: a side wall and a longitudinal axis, the device comprising: a tube extending transversely through the stack side wall, the tube having an input end, a midportion and an output end; mounting means for mounting the tube to the stack side wall; nozzle means disposed on the output end of the tube for spraying a fire extinguishing compound in an upstream direction; trap means disposed within the midportion of the tube for impeding backflow of solid particles from the interior of the stack through the side wall; and fire extinguishing compound injection means disposed on the input end of the tube for conveying compound from a source of extinguishing compound.

The trap means within the midportion impedes backflow of solid particles substantially eliminating the risk of fire from hot falling cinders.

The device is easily mounted to conventional sheet metal stacks with self tapping sheet metal screws. By drilling a larger hole in the stack for insertion of the tube, then smaller holes for the mounting screws, the device may be quickly installed by relatively unskilled persons in a short time. The device can be periodically inspected and cleaned if necessary by simply removing the mounting screws.

The provision of a conical adaptor at the outer end of the tube allows the device to be used with a variety of standard fire extinguishers.

Therefore, with only commonly available tools and low level of skill, the device can be quickly and easily installed, maintained and used.

Further details of the invention and its advantages will be apparent from the detailed description and drawings included below.

BRIEF DESCRIPTION OF THE DRAWINGS

In order that the invention may be readily understood, a preferred embodiment of the invention and variations thereof will be described by way of example, with reference to the accompanying drawings wherein:

FIG. 2 is a detail view of the access tube;

FIG. 3 is a sectional view along line 3—3 of FIG. 2;

DETAILED DESCRIPTION OF PREFERRED EMBODIMENTS

Figure 1:
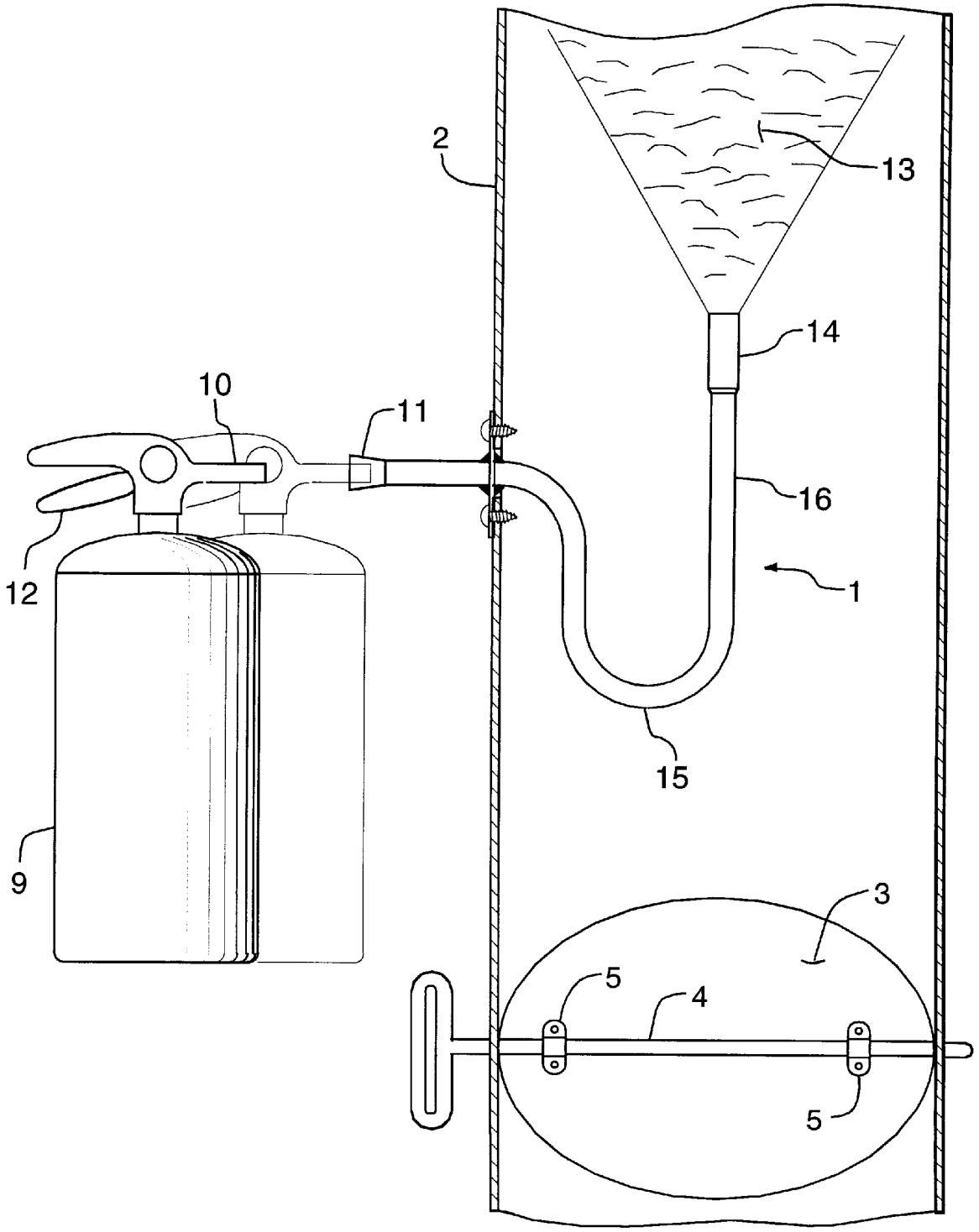
FIG. 1 is a vertical sectional view through a chimney stack showing the access device in the form of a tube with an output nozzle, a midportion U-trap, mounting plate and input adaptor to receive the spray nozzle of a portable fire extinguisher.

With reference to FIG. 1, a preferred embodiment of the invention is shown in the form of a tube 1 installed in a conventional elongate vertical sheet metal chimney stack 2. The tube 1 is preferably installed above, or in other words downstream, of the damper 3. From experience it is known that most chimney fires occur downstream of the damper 3, and locating the tube above the damper 3 avoids blocking the flow of fire extinguishing compound with the damper 3.

Commonly, sheet metal chimney stacks 2 extend substantially vertically from the flue of a metal wood stove. Preformed rolled stack pipe sections are fitted together with an upper end of each section being crimped inwardly to slide in the bottom end of the adjacent pipe section. The typical damper 3 shown is preinstalled in a single section before assembly with other sections by merely drilling two holes in a standard section, then threading the handle pin 4 through the holes and damper brackets 5.

Figure 4:
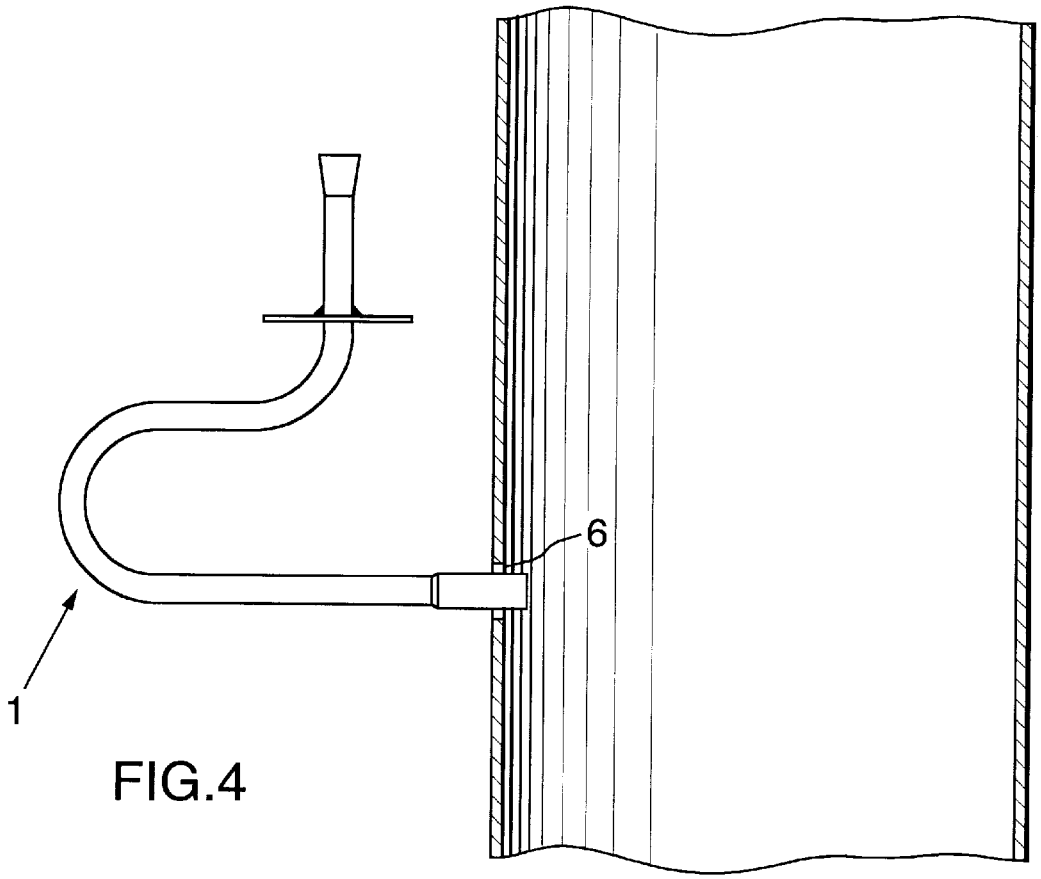
FIGS. 4, 5 and 6 are vertical sectional views similar to FIG. 1 showing the progressive installation of the device through a hole drilled in a typical sheet metal chimney stack.
Figure 5:
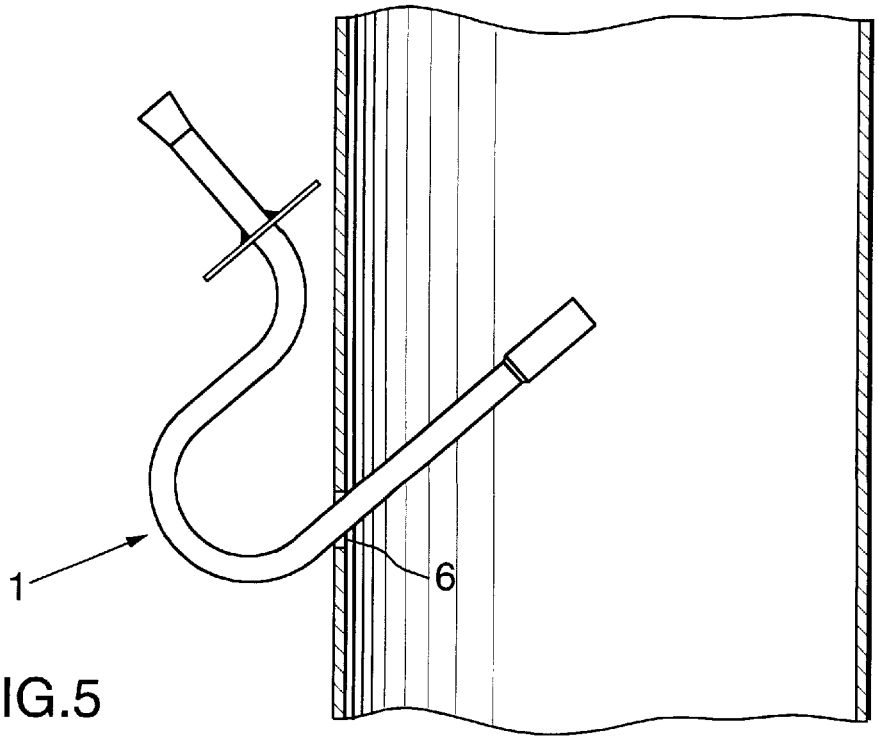
Figure 6:
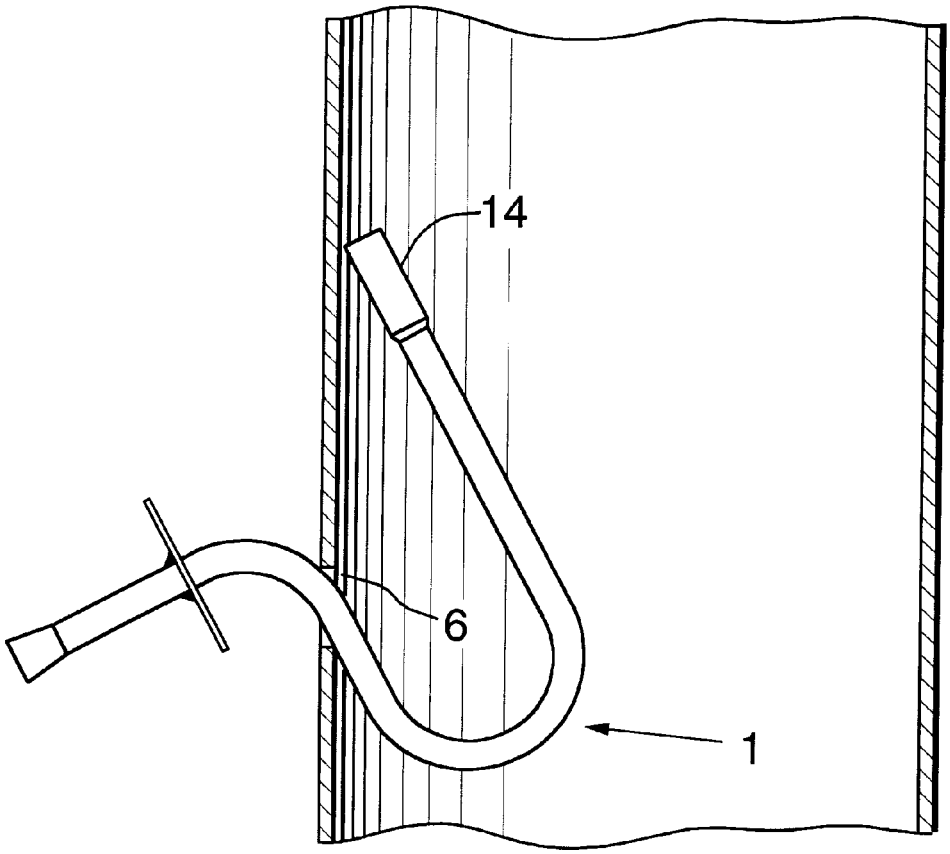

In a like manner, as shown in FIG. 2, the tube 1 is preinstalled by drilling a hole 6 in the stack section 2, then inserting the tube 1, as shown in FIGS. 4, 5 and 6. The size of the hole 6 is small enough to be covered by the mounting plate 7 and provide backing support for the self tapping mounting screws 8, while being large enough to permit insertion of the bent tube 1 as indicated in FIGS. 4–6.

After insertion of the tube 1 in the hole 6, the positions of screws 8 are drilled in the stack 2 using the holes in the mounting plate 7 as a template. Self tapping sheet metal screws 8 are driven to complete the installation.

It will be apparent that an advantage of the invention is that it can be easily retrofitted to existing chimney stacks 2, or can be prefabricated as an integral part of manufactured stack sections sold as a unit. Although a permanently fixed tube 2 can be welded to a stack pipe section as a prefabricated unit, it is considered advantageous to use the mounting plate 7 and screws 8 in all installations, since periodic inspection and cleaning is desirable during use to ensure that the tube 1 remains unblocked by resin, soot or debris.

Referring to FIG. 1, the preferred use of the device 1 is illustrated. Fire extinguishing compound is injected into the interior of the chimney stack 2 from a separable portable fire extinguisher 9. The nozzle 10 of the extinguisher 9 is received in a splayed adaptor 11 at the input end of the tube 1. The trigger 12 of the extinguisher 9 is manually squeezed to spray fire extinguishing compound 13 through the tube 1 and out the spray nozzle 14 at the output end of the tube 1.

Figure 7:
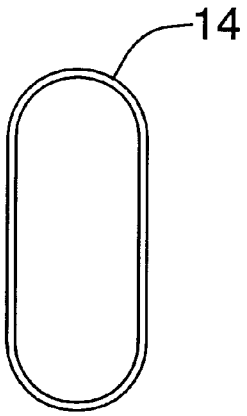
FIG. 7 is an end view of a nozzle formed by flattening the output end of the tube, indicated by line 7—7 of FIG. 2.
Figure 8:
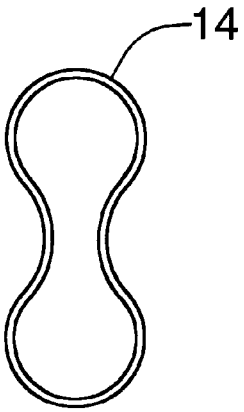
FIG. 8 is an end view of an alternative nozzle formed by crimping the output end of the tube.
Figure 9:
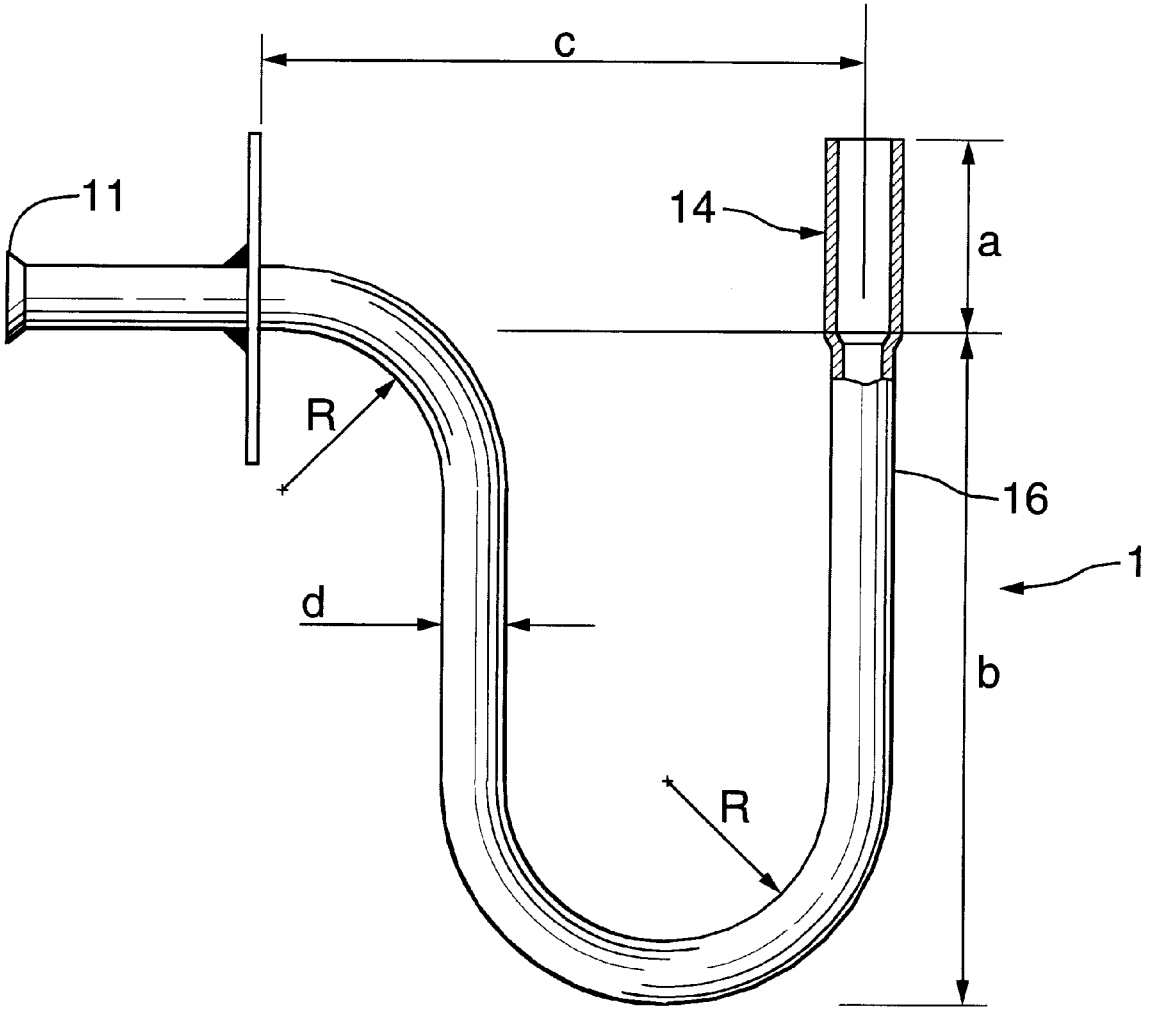
FIG. 9 is a side elevation view showing an example of the relationship between various dimensions in order to ensure insertion of the tube is possible in a vertical chimney stack.

As indicated in FIG. 1, the spray pattern of compound 13 is predetermined by choice of the shape of the nozzle 14. The nozzle 14 shape is selected to propel compound to the inside walls of the stack 2 while also propelling compound significantly up the stack 1 to extinguish a fire in an extended area of the stack 2. FIG. 7 shows a nozzle 14 formed by flattening the output end of the tube 1, whereas FIG. 8 shows a nozzle formed by crimping the output end of the tube 1. Different shapes of nozzles 14 will produce different flow patterns of compound. In a very long stack 2, or one with several bends, a plurality of tubes 1 can be installed along the stack length to ensure proper coverage.

The features of the invention will now be described in detail. The stack 2 as illustrated has cylindrical side walls and a central longitudinal axis, however within the contemplation of the invention are a variety of stack shapes such as elliptical, square, and conical to which the invention can be applied with equal advantage.

The device generally comprises a tube 1 extending transversely through the stack 2 side walls. To mount the tube 2 to the side walls of the stack 2, mounting plate 7 is provided. The plate 7 is fabricated with a central hole through which the tube 2 extends. The metal tube 2 is welded or brazed together with the mounting plate 7 at right angles in a jig during manufacture. The mounting plate 7 includes screw holes to accommodate self tapping screws 8. The screws 8 provide a simple means to releasably fasten the plate 7 to the stack 2. The releasable feature is important to provide periodic access for inspection and cleaning.

The tube 1 has three sections, namely an input end, a midportion and an output end. Means to inject a fire extinguishing compound 11 is disposed on the input end of the tube 1 for conveying compound from a source 9 of extinguishing compound 13. In the illustrated example, the source of compound is a separate portable fire extinguisher 9 and the input end includes a frustoconical splayed adaptor 11 configured to accommodate a variety of sizes of nozzles 10 used on commonly available extinguishers 9.

The output end of the tube 1 includes a nozzle 14 for spraying fire extinguishing compound 13 in an upstream direction. The nozzle 14 preferably also includes a vertical section 16 of the tube 1 coaxial to the stack 2. The vertical section 16 provides for uniform distribution of compound 13 expelled from the nozzle 14.

The draft of the air flow up the stack 2 caused by the fire also serves to draw compound 13 upstream and improves distribution throughout the stack 2 during a fire. It will be apparent that use of the device does not require the user to extinguish the fire within the wood stove when a chimney fire occurs, although this should probably be done afterwards if the extinguisher 9 contains sufficient compound to ensure that the chimney fire is completely extinguished.

The midportion of the tube 1 includes trap means 15 for impeding backflow of solid particles from the interior of the stack 2 through the side wall. As discussed above with reference to the Sawtelle patent, without a trap 15, soot and cinders fall into the nozzle 14 and are expelled into the interior of the building through adaptor 11.

To provide a simple trap 15, a section of the tube 1 is bent in a longitudinally curved manner. Preferably for ease of manufacture the trap 15 includes a reverse bend to form a U-shaped gravity trap disposed in a vertical plane. Within the contemplation of the invention however, a variety of different trap means could also be provided. For example a screened filtering section in the tube 1 could be provided, or the midportion could be formed as a coil to trap solid particles. However for ease of installation, manufacturing, use and maintenance, the illustrated U-shaped trap is considered preferable.

It will be apparent from a review of FIGS. 4–6 that the relative dimensions of the tube 1 and nozzle 14 must be designed with the method of installation and insertion in mind. When the tube is retrofitted as illustrated, it is necessary to rotate the tube 1 around the trap 15 with the tube in the hole 6 and interference with the vertical walls of the chimney stack 2 would prevent installation.

One example of relative dimensions is described below with reference to FIG. 8. The of nozzle 14 was designed at 1 inch from the underside of the tube 1 horizontal portion. Dimension "b" for the depth of the trap 15 was set at 3¼ inch, and radii "R" at ⅞ inch. As a result, the dimension "c" is (2R +1.5 d) 2⁷⁄₃₂ inch. It will be understood that this is but one example of relative dimensions that work, however, a skilled designer may provide any number of equally workable dimensions for particular applications.

Although the above description and accompanying drawings relate to specific preferred embodiments as presently contemplated by the inventor, it will be understood that the invention in its broad aspect includes mechanical and functional equivalents of the elements described and illustrated.

I claim:

1. A chimney fire access device for permitting emergency access to inject a fire extinguishing compound, from the nozzle of a hand held portable fire extinguisher independent of the chimney, into the interior of an elongate vertical chimney stack, the stack having: a side wall aid a longitudinal axis, the device comprising:

a tube extending transversely through the stack side wall, the tube having an input end, a midportion and an output end;

mounting means for mounting the tube to the stack side wall;

upwardly open nozzle means disposed on the output end of the tube for spraying a fire extinguishing compound in an upstream direction;

U-shaped gravity trap means disposed within the midportion of the tube for trapping ash particles that fall from the interior of the stack into the tube through the upwardly open nozzle means, preventing said ash particles from passing through the tube and out of the chimney stack when; and splayed adaptor means for receiving the fire extinguisher nozzle disposed on the input end of the tube and during operation of the fire extinguisher conveying compound from a source of extinguishing compound.

2. A device according to claim 1 wherein the nozzle means comprise a vertical section of the tube.

3. A device according to claim 2 wherein the vertical section is coaxially disposed relative to the stack.

4. A device according to claim 1 wherein the nozzle means comprise a flattened output end of the tube.

5. A device according to claim 1 wherein the nozzle means comprise a crimped output end of the tube.

6. A device according to claim 1 wherein the mounting means comprise a plate through which the tube extends and releasable fastening means for securing the plate to the stack.

7. A device according to claim 6 wherein the fastening means comprise at least one self tapping screw.

* * * * *